United States Patent [19]

Carlile

[11] 4,094,029

[45] June 13, 1978

[54] SHOE FASTENER

[76] Inventor: Alfred E. Carlile, 572 Chestnut St., Meadville, Pa. 16335

[21] Appl. No.: 787,698

[22] Filed: Apr. 14, 1977

[51] Int. Cl.[2] ..... A43D 5/00; F16G 11/00; A44B 17/00

[52] U.S. Cl. ..... 12/113; 24/117; 24/207

[58] Field of Search ..... 12/113; 36/50, 51; 24/117 R, 120, 121, 122, 207

[56] References Cited

U.S. PATENT DOCUMENTS

| | | | |
|---|---|---|---|
| 616,289 | 12/1898 | Crawford | 12/113 |
| 624,287 | 5/1899 | Baker | 12/113 |
| 743,194 | 11/1903 | Reilley | 12/113 |
| 785,789 | 3/1905 | Barna et al. | 12/113 |

FOREIGN PATENT DOCUMENTS

| | | | |
|---|---|---|---|
| 856,780 | 10/1940 | France | 12/113 |

*Primary Examiner*—Patrick D. Lawson
*Attorney, Agent, or Firm*—O'Brien & Marks

[57] ABSTRACT

An integrally molded fastener for a shoe includes a pair of elongated carrier members hinged together at the bottom ends thereof and which can be releaseably secured together. Flexible string-like members extend from carrier members for passing through the eyelets of the shoe. Each of the string-like members has one or more protrusions for interlocking with apertures formed in the carriers.

13 Claims, 9 Drawing Figures

FIG.1
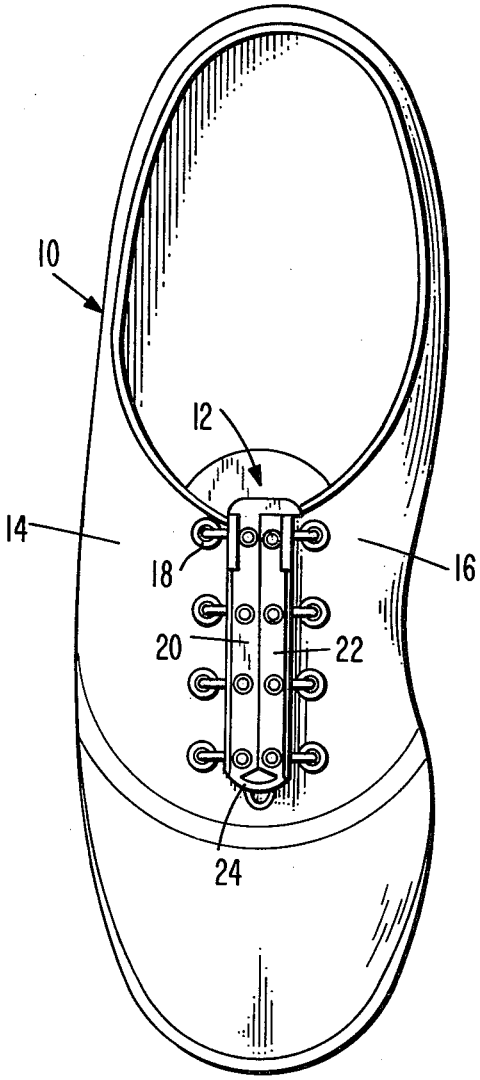
FIG. 2
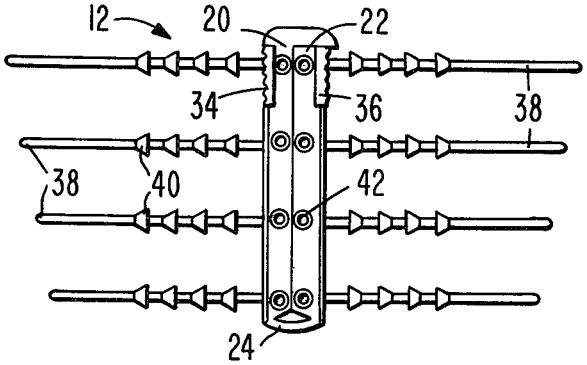
FIG. 3
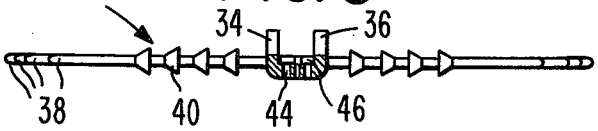
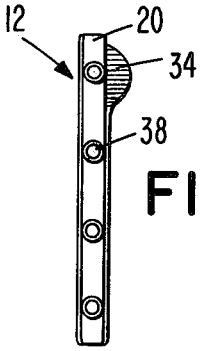
FIG. 4
FIG. 5
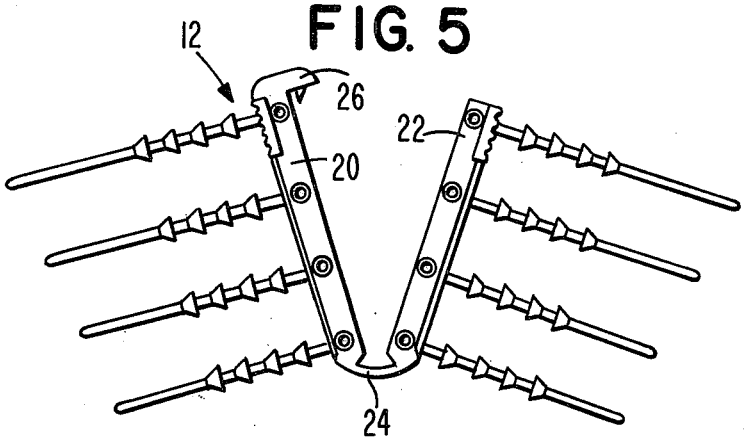
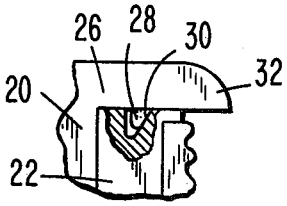
FIG. 6

SHOE FASTENER

BACKGROUND OF THE INVENTION

1. Field of the Invention

This invention relates to fasteners or closures for shoes and particularly to fasteners for replacing shoelaces threaded through eyelets of shoes. p 2. Description of the Prior Art Many shoes employ shoelaces threaded through eyelets in opposite flaps of the shoes to secure the shoes on the feet of the wearers. However the threading, pulling and tying of the shoelaces is difficult for many young children and handicapped or infirm people.

A number of shoe closures, such as is exemplified in U.S. Pat. Nos. 2,814,085; 2,839,804; 738,399; 1,678,273; 2,637,087 and 2,867,878, have been disclosed in the prior art to replace the common shoelaces. These prior art closures generally have one or more deficiencies such as requiring the manufacture and assembly of a number of separate parts and thus being excessively expensive, requiring special tools or equipment or otherwise being difficult to install on shoes, being incapable of adjustment for different spacings between the shoe flaps so that the shoes can be fit to the wearer's feet, requiring rather complicated actions to open and close, requiring a relatively long length of longitudinal movement such as with slide closures, etc.

SUMMARY OF THE INVENTION

The invention is summarized in a fastener for a shoe which has opposite flaps with eyelets therein, the fastener including a pair of elongated carriers, hinge means connecting one ends of the pair of carriers together, means for releaseably securing the carriers together, the pair of carriers having respective apertures, flexible string-like members joined to each of the carriers for passing through the eyelets of the shoe and for being received in the respective apertures, and the flexible string-like members each having a protrusion for interlocking with the respective carrier at the respective aperture.

An object of the invention is to eliminate the necessity of threading and pulling a shoelace through eyelets in a shoe and tying the shoelace in a bow following the placement of the shoe on the foot and as well as the untying and loosening of the shoelace to remove the shoe.

Another object of the invention is to construct a single integrated fastener which can be easily installed in a shoe having eyelets and which can be easily opened and closed.

It is another object of the invention to design a shoe fastener which is economical to manufacture by injection molding of a plastic material without the use of retractable cores and which can be molded in multiple cavity type molds.

One advantage of the fastener of the invention is that the entire fastener can be molded in various colors or dyed after molding to match the shoe.

Another advantage of the invention is that it can withstand the rigors of home laundry without removing from rubber or canvas type footwear.

Additional features of the invention include the provision of a plurality of spaced protrusions on each string-like member for selectively adjusting the tightness of the shoe on the wearer, an extension of one carrier over the top of the other carrier including a locking projection mating with a recess together with an overhang to enable the extension to be bent back and release the carriers; a bottom hinge structure having a resilient arcuate band extending from the outer edges of the carriers to provide for increased flexibility and securement of the alignment of the carriers; and thumb and finger gripping protrusions on the carriers for assisting in the closing of the carriers.

Other objects, advantages and features of the invention will be apparent from the following description of the preferred embodiment taken in conjunction with the drawings.

BRIEF DESCRIPTION OF THE DRAWINGS

FIG. 1 is a top view of a shoe including a shoe fastener installed therein in accordance with the invention.

FIG. 2 is a plan view of the shoe fastener of FIG. 1 in a closed position prior to installation in the shoe.

FIG. 3 is a cross section view of the fastener of FIG. 2.

FIG. 4 is a side view of the shoe fastener of FIG. 2.

FIG. 5 is a plan view similar to FIG. 2 but with the shoe fastener in an open position.

FIG. 6 is an enlarged view of a broken away locking portion, partially in cross section, of the shoe fastener of FIG. 2.

DESCRIPTION OF THE PREFERRED EMBODIMENT

Figure 7:
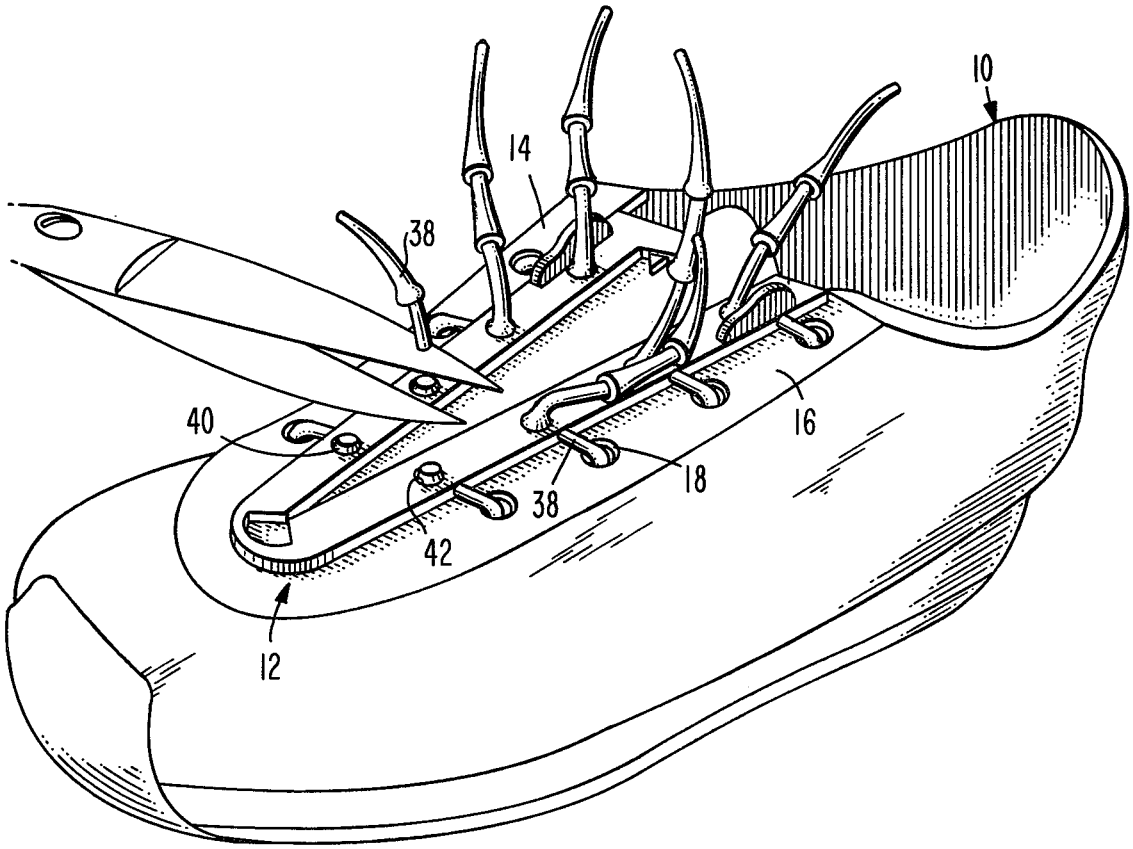
FIG. 7 is a perspective view of the shoe and the shoe fastener of FIG. 1 illustrating an intermediate step in the installation of the shoe fastener on the shoe.

An embodiment of the invention is illustrated in FIG. 1 including a shoe indicated generally at 10 with a fastener indicated generally at 12. The shoe 10 is a conventional shoe with uppers having flaps 14 and 16 each with a plurality of spaced eyelets 18 for normally receiving a shoelace to secure the shoe.

The fastener 12, as shown in FIGS. 2–6 and which takes place of the conventional shoelace, is a single integrated component formed from a suitable material, such as an injection molded polyamide resin or other plastic material, which is reasonably flexible and elastic and can be molded in various colors or dyed after molding. The shoe fastener 12 has a pair of longitudinal carrier portions 20 and 22 which have a thickness and width to produce relatively rigid carriers for the fastener. A hinge such as resilient arcuate band 24 joins the bottom ends of the carriers 20 and 22; the band 24 particularly connected at its opposite ends to the outside portions of the bottom ends of the carriers 20 and 22 so that the band 24 has a substantial length. The shoe fastener 12 is initially formed in the open condition as shown in FIG. 5 so that the arcuate band 24 has a bias toward the open position. The left carrier 20 has an upper extension 26 which extends over the top of the right member 22 and has a locking projection 28 which engages in a locking recess 30 in the upper end of the right hand carrier 22 when the fastener is closed. The end 32 of the extension 26 overhangs or extends past the carrier 22 so that it may be easily lifted to release the locking projection 28 from the locking recess 30 to permit the carriers 20 and 22 to be separated. The carriers 20 and 22 are also provided with respective raised finger grips 34 and 36 to aid in closing the carriers 20 and 22 to the closed position.

Integrally connected with the outer edges of each of the carriers 20 and 22 are a plurality of string-like members 38 corresponding in number and spacing to the eyelets 18 (FIG. 1) in each of the flaps 14 and 16 of the shoe 10. Each of the string-like members 38 has a plurality of spaced tapered locking protrusions such as cones 40 in a segment of the members 38 adjacent to the base end of the members 38 connected to the respective carrier 20 or 22. The free ends of the string-like members 38 have substantial lengths free of any of the tapered locking protrusions 40 so as to form leaders which may be easily threaded through the eyelets 18 and through corresponding apertures or openings 42 such as round holes 42 formed in the carriers 20 and 22. The openings 42 are aligned laterally with the respective string-like members 38 and are counterbored so as to result in a narrow diameter lower portion 44 sufficient in diameter to freely receive the leader end of the string-like members 38 but to restrict passage of the locking protrusions 40 and to result in a larger diameter upper portion 46 to recess the locking protrusions 40 below the upper surface of the carriers 20 and 22. The locking protrusions 40 are tapered with the narrow ends toward the free ends of the string-like members 38 having the same diameter as the string-like members 38. The size of the locking protrusions 40 relative to the opening 42 is selected so that the resilience of the material forming the protrusions 40 and carriers 20 and 22 permits the protrusions 40 to be pulled narrow ends first through the openings 42. The butt or large end of each protrusion 40 is designed to substantially prevent the protrusions from being pulled back through the openings 42.

Figure 8:
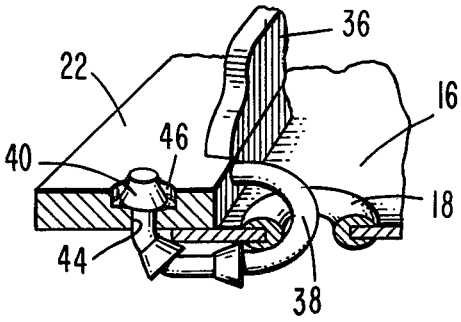
FIG. 8 is a cross section view of a broken-away part of the assembled shoe fastener and shoe of FIG. 1.

In installation of the shoe fastener 12 in the shoe 10 as shown in FIGS. 7 and 8 with the fastener in the open position, the leader ends of the string-like members 38 are threaded downward through the corresponding eyelets 18, underneath the inner edges of the shoe flaps 14 and 16, and back up through the corresponding opening 42 in the corresponding carrier 20 or 22. Then the leader is pulled with sufficient force to cause the outmost locking projection 40 to be pulled through the lower portion 44 of the opening 42 which then locks with the seat formed by the enlarged upper portion 46 of the opening 42. This preliminary threading of the string-like members 38 is made progressively until all of the string-like members 38 have been threaded to their corresponding eyelets 18 and openings 42.

With the shoe fastener 12 in the opened position, the shoe is now placed on the foot of the wearer and the fastener 12 is closed and locked by pressing the thumb and finger projections 34 and 36 together to lock the locking projection 28 in the locking recess 30. Further adjustment of the shoe fastener is made by pulling on pairs of the leaders beginning with the lowermost pair of string-like members 38 to pull additional locking protrusions through the openings 42, and progressing upward until all of the string-like members 38 are adjusted to secure the shoe to the wearer's satisfaction with the shoe fastener centered with respect to the flaps 14 and 16. Finally, the residual portions of the string-like members 38 projecting upward from the carriers 20 and 22 are trimmed flush with the carriers 20 and 22 by the use of a scissors, nail clippers, knife, or the like leaving a neat and finished appearance.

Thereafter the flaps 14 and 16 may be easily opened and closed to permit the shoe 10 to be removed or placed upon the foot of the wearer. Opening of a shoe fastener 12 is accomplished by lifting the overhanging end 32 of the projection 26 to release the locking lug 28 from the locking recess 30; the bias of the hinge 24 helps urge the carriers 20 and 22 to pivot apart opening the flaps 14 and 16. Closing is accomplished by pressing together the finger grips 34 and 36 until the locking tab 28 snaps into the locking recess 30. Opening and closing is accomplished with light pressure and does not require any great length of longitudinal movement by the wearer such as needed in a slide operated closure.

The shoe fastener 12 does not require any special tools or assembly of separate parts for installation. The threading and pulling of the string-like members 38 and the cutting off of the residual portions can be readily performed without any particular skill or training. Further the plurality of locking protrusions 40 spaced longitudinally on each of the string-like members 38 permits the fitting of the shoe with the fastener 12 to the wearer's foot; this is accomplished during the installation.

The arcuate band 24 biasing the flaps 14 and 16 open also aids in the ease of placement of the shoe on the foot. The length of the arcuate band 24 between the outer edges of the carriers 20 and 22 results in less change in radius of curvature on the band than if it were shorter; this produces a longer lasting hinge. Further the stress in the band 24 when the fastener is closed helps prevent accidental opening of the fastener due to varying forces imposed during walking.

The resiliency of the string-like members 38 permits limited expansion and contraction of the shoe upper due to physical stresses and changes of the foot during walking. Thus the shoe is more comfortable then when the uppers are not permitted to expand and contract.

The shoe fastener 12 can be made in multiple cavity type molds without retractable cores and the like; thus it can be made in large volumes with a minimum expense.

Additionally the single integrated molded fastener can be easily made one color throughout to match the color of the shoe. The color may be mixed in the plastic resin or the fastener may be dyed.

It is noted that the fastener 12 can be installed on either the left or right shoe. Canvas and rubber footwear can be laundered without removing the fastener.

Figure 9:
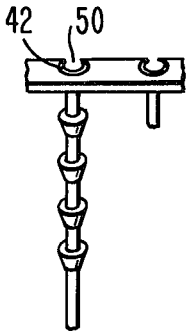
FIG. 9 is a plan view of a broken away portion of a modified shoe fastener in accordance with the invention.

In a modification of the shoe fastener as shown in FIG. 9, the openings 42 include slot portions 50 extending to the inner edges of the carriers. These slot portions 50 are slightly smaller in width than the diameter of the round hole portions of the openings so that the thread like members 38 are retained within the round hole portions but can be relatively easily removed from the openings 42 if need be.

Since the invention is subject to many variations, modifications and changes in detail, it is intended that all matter in the foregoing description or shown in the accompanying drawings be interpreted as illustrative and not in a limiting sense.

What is claimed is:

1. A fastener for a shoe which has opposite flaps with eyelets therein, the fastener comprising a pair of elongated carriers, hinge means connecting one ends of the pair of carriers together, means for releasably securing the carriers together, the pair of carriers having respective apertures, flexible string-like members joined to each of the carriers for passing through the eyelets of the shoe and for being received in the respective apertures, and said flexible string-like members each having a protrusion for interlocking with the respective carrier at the respective aperture.

2. A fastener for a shoe as claimed in claim 1 wherein each of said flexible string-like members have a plurality of spaced protrusions for selectively interlocking with the respective carrier at the respective aperture.

3. A fastener for a shoe as claimed in claim 1 wherein each of the protrusions for interlocking with the respective carrier is tapered with the smaller end extending toward the free end of the respective string-like member.

4. A fastener for a shoe as claimed in claim 2 wherein each of the spaced protrusions on each of the flexible string-like members are tapered with the smaller end thereof facing the free end of the respective string-like member.

5. A fastener for a shoe as claimed in claim 1 wherein each of the apertures have an upper portion with a substantially larger diameter for receiving the locking projection so as to recess the locking projection relative to the surface of the respective carrier.

6. A fastener for a shoe as claimed in claim 1 wherein the hinge means includes an arcuate flexible band extending between the outer edge portions of the lower ends of the carriers.

7. A fastener for a shoe as claimed in claim 6 wherein the band is formed with a bias toward the open position of the carriers.

8. A fastener for a shoe as claimed in claim 1 wherein the fastener is formed from a molded integral plastic.

9. A fastener for a shoe as claimed in claim 1 wherein the means for releaseably securing the carriers includes an extension on one carrier over the top of the other carrier, a locking projection extending from the extension, and a recess formed in the other carrier to receive and interlock with the locking projection.

10. A fastener for a shoe as claimed in claim 9 wherein the extension has an end portion which extends past the other carrier to form an overhang which can be lifted to enable opening of the shoe fastener.

11. A fastener for a shoe as claimed in claim 1 including a pair of raised finger grips on the upper ends of the respective carriers.

12. A fastener for a shoe as claimed in claim 1 wherein the apertures include slot portions extending to the inner edges of the carriers.

13. A fastener for a shoe as claimed in claim 12 wherein the apertures include round hole portions, and the slot portions have a width less than the round hole portions to retain the string-like members in the round hole portions.

* * * * *